United States Patent [19]

Cordell

[11] Patent Number: 4,802,471

[45] Date of Patent: Feb. 7, 1989

[54] LEVELER ATTACHMENT FOR LADDERS

[76] Inventor: James E. Cordell, 42 Florida Pl., Asheville, N.C. 28806

[21] Appl. No.: 162,158

[22] Filed: Feb. 3, 1988

[51] Int. Cl.[4] ..... E06C 7/44

[52] U.S. Cl. ..... 182/204; 182/184

[58] Field of Search ..... 182/201, 202, 204, 205, 182/184; 248/354.1, 354.7, 188.2, 188.5

[56] References Cited

U.S. PATENT DOCUMENTS

| | | | |
|---|---|---|---|
| 644,567 | 3/1900 | Baetz | 182/205 |
| 796,915 | 8/1905 | Ketchum . | |
| 908,387 | 12/1908 | Boyd . | |
| 1,177,069 | 3/1916 | Verow et al. . | |
| 1,329,740 | 2/1920 | Barrow | 182/205 |
| 1,692,152 | 11/1928 | Bosco | 248/354.1 |
| 1,862,171 | 6/1932 | Baker . | |
| 1,887,495 | 11/1932 | Carter | 182/205 |
| 1,978,865 | 10/1934 | Haines | 248/354.1 |
| 2,350,116 | 5/1944 | Kimes | 182/201 |
| 2,503,626 | 4/1950 | Mayberry | 182/201 |
| 2,634,942 | 4/1953 | Hughes | 248/354.1 |
| 3,908,796 | 9/1975 | Hurwitz | 182/201 |
| 3,933,222 | 1/1976 | Craig | 182/204 |
| 3,948,352 | 4/1976 | Larson | 182/204 |

FOREIGN PATENT DOCUMENTS

| | | | |
|---|---|---|---|
| 195584 | 4/1938 | Switzerland | 182/205 |

*Primary Examiner*—Reinaldo P. Machado
*Attorney, Agent, or Firm*—David M. Carter

[57] ABSTRACT

There is provided a ladder having a leveler attached thereto. The leveler includes a T-shaped gripping device having a sharp edge which contacts the smooth surface of an adjacent slidable rail for locking the rail into position. The slidable rail acts as one of the legs of the ladder to level the ladder. The leveler has an infinite number of increments of adjustment so that the ladder may be used on most any slope.

11 Claims, 2 Drawing Sheets

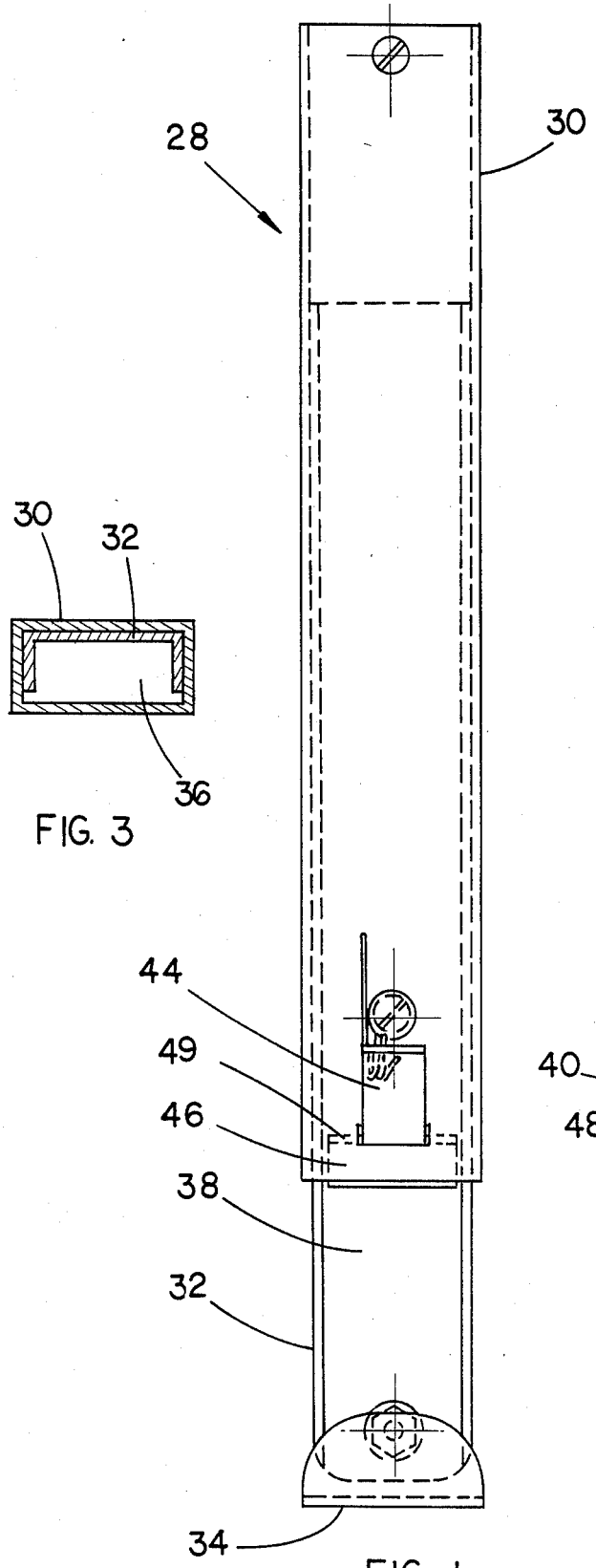
FIG. 1
FIG. 3
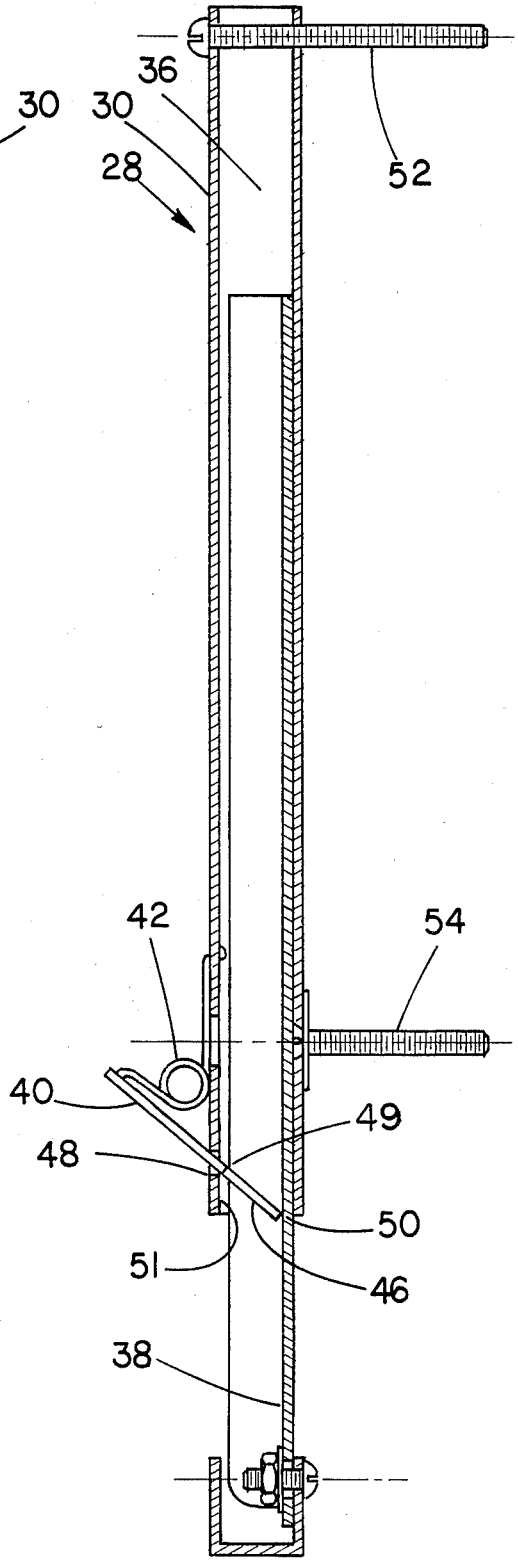
FIG. 2

LEVELER ATTACHMENT FOR LADDERS

BACKGROUND OF THE INVENTION

This invention relates to ladders. More particularly it relates to ladders with adjustable legs for use on uneven surfaces.

The common ladder is very useful when the legs are resting on a flat surface, however when one attempts to use a ladder with fixed legs on an inclined or uneven surface, it not only is not useful but it becomes a dangerous instrument if one attempts to climb the ladder.

There have been various attempts to provide a ladder with an extendable leg or legs so that the ladder will be level on various inclined surfaces. One such ladder is shown in U.S. Pat. No. 3,882,966 issued to Fasano. The Fasano patent shows an extension device attached to the outside of one of the legs of the ladder. A slidable rail is provided within the Fasano extension and includes a plurality of discrete ratchets which are adapted to engage with a pawl. One of the major drawbacks of the Fasano ladder is that because of these discrete ratchets, the ladder will only be level when the surface upon which it is resting corresponds with a particular ratchet, which of course is an unlikely occurrence.

There are various other teachings of the use of discrete ratchets or holes in an extension device in an attempt to level a ladder. Some of those teachings are shown in the following U.S. patents: U.S. Pat. Nos. 3,948,352, 796,915, 1,177,069, 3,933,222, 1,329,740, 1,862,171, 644,567, 908,387, 2,503,626, and Swiss Patent No. 195584.

U.S. Pat. No. 3,908,796 issued to Hurwitz shows a ladder leveling device which does not utilize ratchets but includes a pair of extension legs which project outwardly from the ladder and which are held in place because of moments of force on each leg which tends to spread the legs apart to cause a frictional engagement. It is not believed that any of the levelers for ladders described above have met with substantial commercial success.

OBJECTS OF THE INVENTION

It is therefore one object of this invention to provide an improved ladder.

It is still another object to provide an improved mechanism for leveling a ladder.

It is still another object to provide a ladder having an extension enabling an infinite number of increments of leveling.

SUMMARY OF THE INVENTION

In accordance with one form of this invention there is provided an improved ladder having first and second substantially parallel support beams. A plurality of spaced apart rungs are connected between the support beams forming the steps of the ladder. A leveler is connected to one of the support beams. The leveler includes an elongated bar adapted to slide relative to one of the beams. The bar acts as one of the legs of the ladder when the ladder is on an unlevel surface. The leveler has at least one substantially smooth surface. The leveler includes a gripping device having a sharp edge. The gripping device selectively engages the sharp edge with the substantially smooth surface for holding the bar in a fixed position and for permitting the bar to freely slide past the end of the beam when the sharp edge is not engaging the smooth surface so as to level the ladder.

In another form of Applicant's invention, the above-described ladder leveler itself is provided.

BRIEF DESCRIPTION OF THE DRAWINGS

The subject matter which is regarded as the invention is set forth in the appended claims. The invention itself, together with further objects and advantages thereof, will be better understood with reference to the accompanying drawings in which:

FIG. 1 is a side elevational view of the ladder extender of the present invention.

FIG. 2 is a sectional view of the ladder leveler of FIG. 1 taken though section lines AA.

FIG. 3 is a sectional view of the leveler of FIG. 1 taken through lines BB.

DESCRIPTION OF THE PREFERRED EMBODIMENT

Figure 4:
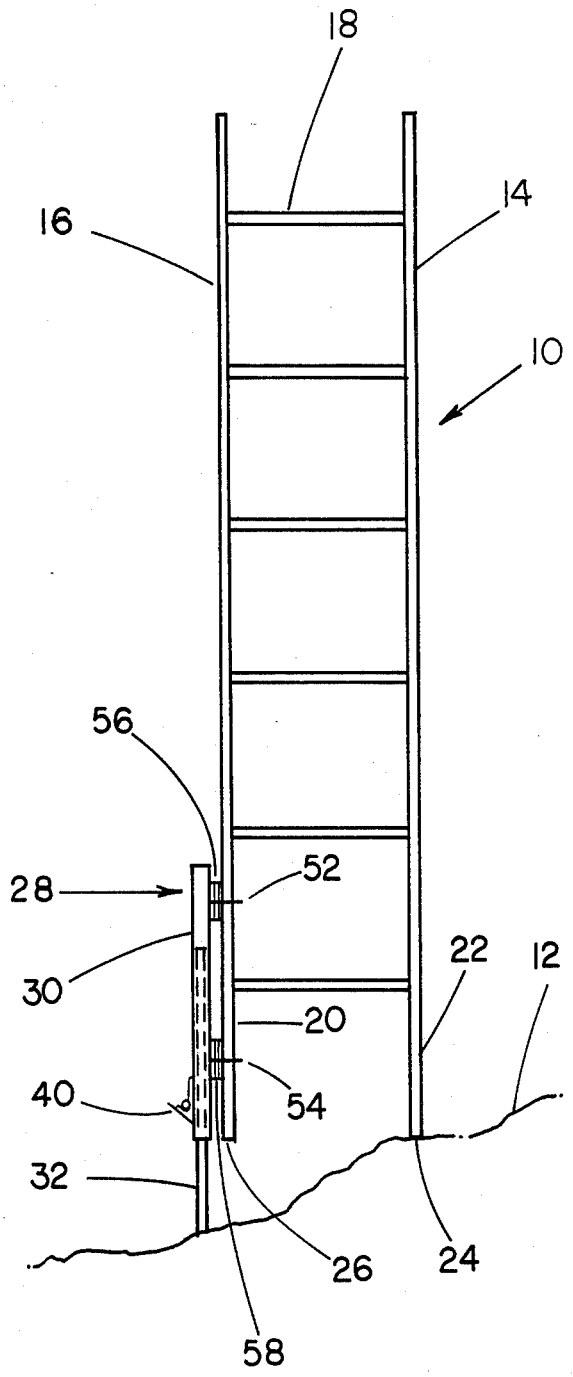
FIG. 4 is a pictorial view of the ladder leveler of FIG. 1 connected to a ladder which is resting on an uneven surface.

Referring now more particularly to FIG. 4, there is provided ladder 10 which is resting on uneven surface 12. Ladder 10 includes first and second substantially parallel support beams 14 and 16 and a plurality of rungs 18 which are connected between the support beams for forming the steps of the ladder. The ladder 10 includes legs 20 and 22 which are part of the lower portions of support beams 14 and 16, respectively. As can be seen, the end 24 of leg 22 is in contact with the surface 12 while the end 26 of leg 20 is not in contact with the surface 12. To compensate for this uneven surface, ladder leveler 28 is connected to beam 16. Leveler 28 will be better understood with reference to FIGS. 1 and 2.

Leveler 28 includes outer rail 30 which is adapted to receive inner rail 32. Swivelable foot 34 is connected to lower portion of inner rail 32. Inner rail 32 is adapted to slide within the channel 36 created by outer rail 30. The channel 36 may be better seen in reference to FIG. 3.

Referring again to FIGS. 1 and 2, inner rail 32 is adapted to slide relative to the outer rail 30 and support beam 16 as shown in FIG. 4. Inner rail 32 includes substantially smooth surface 38. Gripping mechanism 40 is attached to outer rail 30 through spring 42. Gripping mechanism 40 is substantially T-shaped and includes lever bar 44 which is directly connected to spring 42 and further includes edging bar 46. Lever bar 44 is received through hole 48 in the lower portion of rail 30. A pair of shoulders 49 abut against the inner surface 51 of the outer rail to assist in holding the gripping mechanism in place.

Edging bar 46 includes elongated sharp edge 50 for making contact with smooth surface 38.

Figure 5:
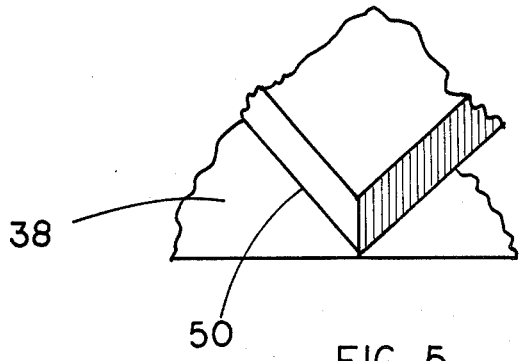
FIG. 5 is an enlarged pictorial view of a portion of FIG. 2.

This may be seen in better reference to FIG. 5 which is a partial pictorial view showing the edge 50 of the gripping mechanism making contact with smooth surface 38. When pressure is placed on lever 40 by compressing spring 42, contact between sharp edge 50 and smooth surface 38 is removed, thus permitting rail 38 to slide within channel 36 formed by outer rail 30, permitting the ladder to be leveled. Because a smooth surface 38 is utilized rather than ratchets, an infinite number of positions, and thus an infinite number of inclined slope surfaces, are possible to the extent of the length of smooth surface 38.

One might expect that since ratchets are not used on surface 38, the leveler would tend to slip when substantial weight has been placed on the ladder. However, quite surprisingly, this is not the case. In fact, it is believed that the more weight applied to the ladder the stronger the bond becomes between gripping mechanism and smooth surface 38 to the extent of the strength of the metal. Applicant has found that when heavy weights are applied to the ladder while the leveler is extended, slight indentations are made into surface 38 by sharp edge 50. The edge 50 bites into surface 38 much like the edge of a ski on ice.

Applicant has tested the apparatus shown in FIG. 4 by first mounting the ladder on an uneven surface then having a man weighing approximately 250 pounds to climb the ladder. The leveler held firm and the man was able to ascend and descend the ladder safely without any slippage of the leveler. The leveler is held onto the ladder by means of bolts 52 and 54. Furthermore, spacers 56 and 58 may also be utilized to provide space between the ladder and the leveler. Preferably the extender is made from substantially non-corrodible materials such as aluminum and stainless steel.

From the foregoing description of the preferred embodiment of the invention it is apparent that many modifications may be made therein, thus it is intended that the appended claims cover all such modifications and falls within the spirit and scope of this invention.

I claim:

1. An improved ladder comprising:

first and second substantially parallel support beams;

a plurality of spaced apart rungs connected between said support beams forming steps of said ladder;

a leveler connected to one of said support beam; said leveler including an elongated bar adapted to slide relative to one of said beams; said bar acting as one of the legs of said ladder when said ladder is on an uneven surface; said leveler having at least one substantially smooth surface; said leveler including a gripping device having a sharp edge; said sharp edge of said gripping device selectively engaging said substantially smooth surface for holding said bar at a fixed position and for permitting said bar to freely slide past the end of said one of said beams when said sharp edge is not engaging said substantially smooth surface so as to level the ladder; said leveler including an outer rail and an inner rail; said outer rail connected to one of said beams; said inner rail being slidable and including said smooth surface; said gripping means connected to said outer rail; said gripping means is substantially T-shaped; an opening in said outer rail; a portion of said gripping means extending through said opening in said outer rail.

2. A ladder as set forth in claim 1 wherein said gripping means including a pair of shoulders abutting against the inner surface of said outer rail to aid in holding said gripping means in place.

3. A ladder as set forth in claim 1 further including a spring connected to said outer rail and further connected to said gripping means for biasing said sharp edges into engagement with said substantially smooth surface on said inner rail.

4. An apparatus as set forth in claim 3 further including means for forcing said sharp edge away from said smooth surface.

5. An apparatus as set forth in claim 4 wherein said inner rail is slidably received in an opening formed by said outer rail.

6. A ladder leveler adapted to be connected to one of the legs of a ladder comprising:

an elongated bar adapted to slide relative to one of the legs of the ladder; said bar acting as one of the legs of the ladder normally when the ladder is on an unlevel surface;

said leveler having at least one substantially smooth surface; said leveler including a gripping device having a sharp edge; said sharp edge of said gripping device for selectively engaging said smooth surface for holding said bar in a fixed position and for permitting said bar to freely slide past the end of one of the ladder legs when said sharp edge is not engaging said substantially smooth surface so as to level the ladder; said leveler including an outer rail and an inner rail; said outer rail connected to one of said beams; said inner rail being slidable and including said smooth surface; said gripping means connected to said outer rail; said gripping means is substantially T-shaped; an opening in said outer rail; a portion of said gripping means extending through said opening in said outer rail.

7. A ladder leveler as set forth in claim 6 wherein said gripping means includes a pair of shoulders abutting against the inner surface of said outer rail to aid in holding said gripping means in place.

8. A ladder leveler as set forth in claim 6 further including a spring connected to said outer rail and further connected to said gripping means for biasing said sharp edges into engagement with said substantially smooth surface on said inner rail.

9. A ladder leveler as set forth in claim 8 further including means for forcing said sharp edge away from said smooth surface.

10. A ladder leveler as set forth in claim 9 wherein said inner rail is slidably received in said outer rail.

11. A ladder leveler as set forth in claim 6 wherein said leveler is made of substantially non-corrodible materials.

* * * * *